US009380807B2

(12) United States Patent
Busby et al.

(10) Patent No.: US 9,380,807 B2
(45) Date of Patent: Jul. 5, 2016

(54) MODIFIED FILTER ROD FEEDING TRAYS FOR POROUS MASSES

(71) Applicant: Celanese Acetate LLC, Irving, TX (US)

(72) Inventors: Paul Busby, Blacksburg, VA (US); Zeming Gou, Pearisburg, VA (US); Ronald Hughes, Narrows, VA (US)

(73) Assignee: Celanese Acetate LLC, Irving, TX (US)

( * ) Notice: Subject to any disclaimer, the term of this patent is extended or adjusted under 35 U.S.C. 154(b) by 0 days.

(21) Appl. No.: 14/311,501

(22) Filed: Jun. 23, 2014

(65) Prior Publication Data

US 2015/0001168 A1 Jan. 1, 2015

Related U.S. Application Data

(60) Provisional application No. 61/840,910, filed on Jun. 28, 2013.

(51) Int. Cl.
*A47F 1/04* (2006.01)
*A47F 5/00* (2006.01)
(Continued)

(52) U.S. Cl.
CPC ..... *A24C 5/358* (2013.01); *A24D 3/0204* (2013.01); *A47B 47/0075* (2013.01);
(Continued)

(58) Field of Classification Search
CPC ..... A24C 5/358; A24D 3/0204; B65D 85/00; B65D 71/70; A47F 5/00; A47F 3/00; A47F 7/007; A47F 7/141; A47F 1/12; A47F 1/04; A47F 3/0004; A47F 2003/008; A47F 3/06; A47F 3/14; A47F 5/0018; A47F 5/0037; A47F 5/0043; A47F 5/0081; A47F 5/10; A47F 7/0007; A47F 7/0014; A47F 7/0021; A47F 7/0035; A47F 7/16; A47F 7/281; A47F 1/06; A47F 1/065; A47F 1/125; A47F 1/126; A47B 57/06; A47B 57/00; A47B 81/007; A47B 47/03; A47B 47/05; A47B 45/00; A47B 47/00; A47B 47/0066; A47B 47/0075; A47B 55/00; A47B 71/00; A47B 85/08; A47B 47/024; A47B 57/20; A47B 57/588; A47B 57/34; A47B 57/16; A47B 2031/003; A47B 57/18; A47B 57/44; F25D 25/02
USPC ..... 211/59.2, 189, 187, 175, 188, 194, 211/49.1, 70.3, 59.4, 51, 134, 72, 126.2, 211/133.1, 10, 11; 312/205, 73, 213, 107, 312/109, 351, 60, 42, 45, 61, 72; 248/235, 248/242, 243, 244
See application file for complete search history.

(56) References Cited

U.S. PATENT DOCUMENTS 1,244,694 A * 10/1917 Blood ..... 211/51
1,662,637 A * 3/1928 Chase ..... 211/59.2
(Continued)

FOREIGN PATENT DOCUMENTS

EP 2489967 A1 8/2012
JP 2002051849 A 2/2002
(Continued)

OTHER PUBLICATIONS

International Search Report and Written Opinion for PCT/US2014/043579 dated Oct. 16, 2014.

*Primary Examiner* — Jennifer E Novosad
(74) *Attorney, Agent, or Firm* — McDermott Will & Emery LLP

(57) ABSTRACT

Modified feeding trays for use in the production of segmented filters may be advantageous when handling filter rods that are porous masses. A modified feeding tray may include a rectangular bottom; opposing first and second sidewalls coupled to corresponding first and second edges of the rectangular bottom; a third sidewall coupled to a third edge of the rectangular bottom and extending between the first and second sidewalls; and a shelf extending between the first and second sidewalls at an intermediate location along a length of each of the first and second sidewalls and thereby defining an open compartment formed by the first and second sidewalls, the shelf, and the bottom, and a closed compartment defined by the first, second, and third sidewalls, the shelf, and the bottom. In some instances, the shelf may be repositionable within the modified feeding tray

6 Claims, 9 Drawing Sheets

(51) Int. Cl.

| | |
|---|---|
| ***A47F 7/00*** | (2006.01) |
| ***A24C 5/358*** | (2006.01) |
| ***A47F 5/10*** | (2006.01) |
| ***A24D 3/02*** | (2006.01) |
| ***A47B 57/44*** | (2006.01) |
| ***A47B 47/03*** | (2006.01) |
| ***A47B 47/00*** | (2006.01) |
| ***A47B 57/18*** | (2006.01) |

(52) U.S. Cl.
CPC ..... *A47B 47/03* (2013.01); *A47B 57/18* (2013.01); *A47B 57/44* (2013.01); *A47F 5/10* (2013.01); *A47F 7/0007* (2013.01); *A47F 7/0035* (2013.01)

(56) References Cited

U.S. PATENT DOCUMENTS

| | | | | | |
|---|---|---|---|---|---|
| 1,971,744 | A | * | 8/1934 | Brykczynski et al. | 211/126.15 |
| 2,672,921 | A | * | 3/1954 | Herrick | 190/12 R |
| 3,079,206 | A | * | 2/1963 | Glezen | 312/109 |
| 3,152,698 | A | * | 10/1964 | Maddox | 211/126.15 |
| 3,481,485 | A | * | 12/1969 | Hess | 211/134 |
| 4,416,463 | A | * | 11/1983 | Marsh et al. | 280/79.3 |
| 4,463,684 | A | * | 8/1984 | Klungle et al. | 108/91 |
| 4,531,645 | A | * | 7/1985 | Tisbo et al. | 211/131.1 |
| 4,697,711 | A | * | 10/1987 | Noren | 211/182 |
| 4,775,057 | A | * | 10/1988 | Zingeser | 211/133.1 |
| 4,795,042 | A | * | 1/1989 | Klein et al. | 211/186 |
| 4,848,859 | A | * | 7/1989 | Edmonds et al. | 312/257.1 |
| 4,919,290 | A | * | 4/1990 | Wadel | 220/503 |
| 4,949,853 | A | * | 8/1990 | Klein et al. | 211/186 |
| 4,982,852 | A | | 1/1991 | Johansen | |
| 5,372,415 | A | * | 12/1994 | Tisbo et al. | 312/108 |
| 5,603,558 | A | * | 2/1997 | Zimmer | 312/290 |
| 5,902,025 | A | * | 5/1999 | Yu | 312/109 |
| 7,309,472 | B2 | * | 12/2007 | Michaelson et al. | 422/297 |
| 7,481,313 | B1 | * | 1/2009 | Kramedjian et al. | 206/427 |
| D623,873 | S | * | 9/2010 | de la Haye | D6/664 |
| 7,850,015 | B1 | * | 12/2010 | Mason | 211/59.2 |
| 7,850,022 | B2 | * | 12/2010 | Fulmer | 211/184 |
| 8,646,650 | B2 | * | 2/2014 | Lockwood et al. | 221/151 |
| 2002/0134744 | A1 | * | 9/2002 | Kessell et al. | 211/187 |
| 2005/0006331 | A1 | | 1/2005 | Engel | |
| 2005/0067926 | A1 | * | 3/2005 | Chiang | 312/258 |
| 2006/0032830 | A1 | | 2/2006 | Engel | |
| 2007/0251899 | A1 | * | 11/2007 | Machala et al. | 211/59.2 |
| 2008/0315734 | A1 | * | 12/2008 | Birsel et al. | 312/223.3 |
| 2011/0084576 | A1 | * | 4/2011 | Leatherman | 312/100 |
| 2015/0001168 | A1 | * | 1/2015 | Busby et al. | 211/59.2 |

FOREIGN PATENT DOCUMENTS

| | | | |
|---|---|---|---|
| WO | 2012006478 | A2 | 1/2012 |
| WO | 2012047346 | A1 | 4/2012 |
| WO | 2012047347 | A1 | 4/2012 |
| WO | 2012047348 | A1 | 4/2012 |
| WO | 2014209842 | A1 | 12/2014 |

* cited by examiner

MODIFIED FILTER ROD FEEDING TRAYS FOR POROUS MASSES

BACKGROUND

The exemplary embodiments presented herein relate to modifications to filter rod feeding trays and shipping containers so that porous masses may be incorporated into the production of segmented filters suitable for use in conjunction with smoking devices.

Porous masses described herein can be incorporated into smoking device filters and have been shown to reduce, and sometimes significantly reduce, the concentration of contaminants in a smoke stream. Generally, porous masses may comprise a plurality of binder particles and a plurality of active particles mechanically bound at a plurality of contact points, also referred to as sintered contact points. As used herein, the terms "mechanical bond," "mechanically bonded," "physical bond," and the like refer to a physical connection that holds two particles at least partially together. Mechanical bonds, which may or may not involve chemical bonding, may be rigid or flexible depending on the binder material and the extent to which the contact points were sintered. It should be understood that as used herein, the terms "particle" and "particulate" may be used interchangeably and include all known shapes of materials, including spherical and/or ovular, substantially spherical and/or ovular, discus and/or platelet, flake, ligamental, acicular, fibrous, polygonal (such as cubic), randomly shaped (such as the shape of crushed rocks), faceted (such as the shape of crystals), or any hybrid thereof.

Filter rods can be produced at one location and shipped to a second (typically a different manufacturer) for producing the segmented filters and, in some instances, the corresponding smoking devices. Porous masses can be fragile and prone to chipping, denting, cracking, and the like, due, at least in part, to the bound nature of the structure and the composition of the binder materials. As such, shipping containers may, in some embodiments, have different strength and design parameters than conventional cellulose acetate filter rods shipping containers.

Producing segmented filters for smoking devices generally utilizes a combining machine where filter rods having various compositions are cut into segments. The filter segments are then combined in a desired order and wrapped and optionally adhered together to secure the segments together to form a segmented filter rod length. The segmented filter rod length can then be cut into segmented filters or segmented filter rods and optionally attached to a smokeable substance like a tobacco column. Utilization of filter rods at the beginning of the process typically involves loading containers of filter rods into feeding trays and loading the feeding trays into the transfer system of the combining machine, both of which are typically performed with mechanical arms. After the feeding trays with shipping containers loaded therein are placed in the transfer system of the combining machine, the shipping container is opened to allow feeding of the filter rods into a feeder.

Conventional filter rods for cigarettes typically consist of acetate cellulose and are about 5 mm to about 7 mm in diameter, about 80 mm to about 150 mm long, and about 0.4 g to about 0.9 g in weight. In some instances, porous masses may weigh about 2 to about 4 times more than a comparably sized conventional cellulose acetate filter rod. Therefore, adjustments to portions of the process for handling filter rods in the production of segmented filter rod may be necessary to accommodate the weight and fragility of the porous masses.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The exemplary embodiments presented herein relate to modifications to filter rod feeding trays and shipping containers so that porous masses may be incorporated into the production of segmented filters suitable for use in conjunction with smoking devices.

It should be noted that when "about" is used herein with reference to a number in a numerical list, the term "about" modifies each number of the numerical list. It should be noted that in some numerical listings of ranges, some lower limits listed may be greater than some upper limits listed. One skilled in the art will recognize that the selected subset will require the selection of an upper limit in excess of the selected lower limit.

Nonlimiting examples of porous masses are described in detail in co-pending applications PCT/US2011/043264, PCT/US2011/043268, PCT/US2011/043269, and PCT/US2011/043270 all filed on Jul. 7, 2012, the entire disclosures of which are included herein by reference.

Figure 1:
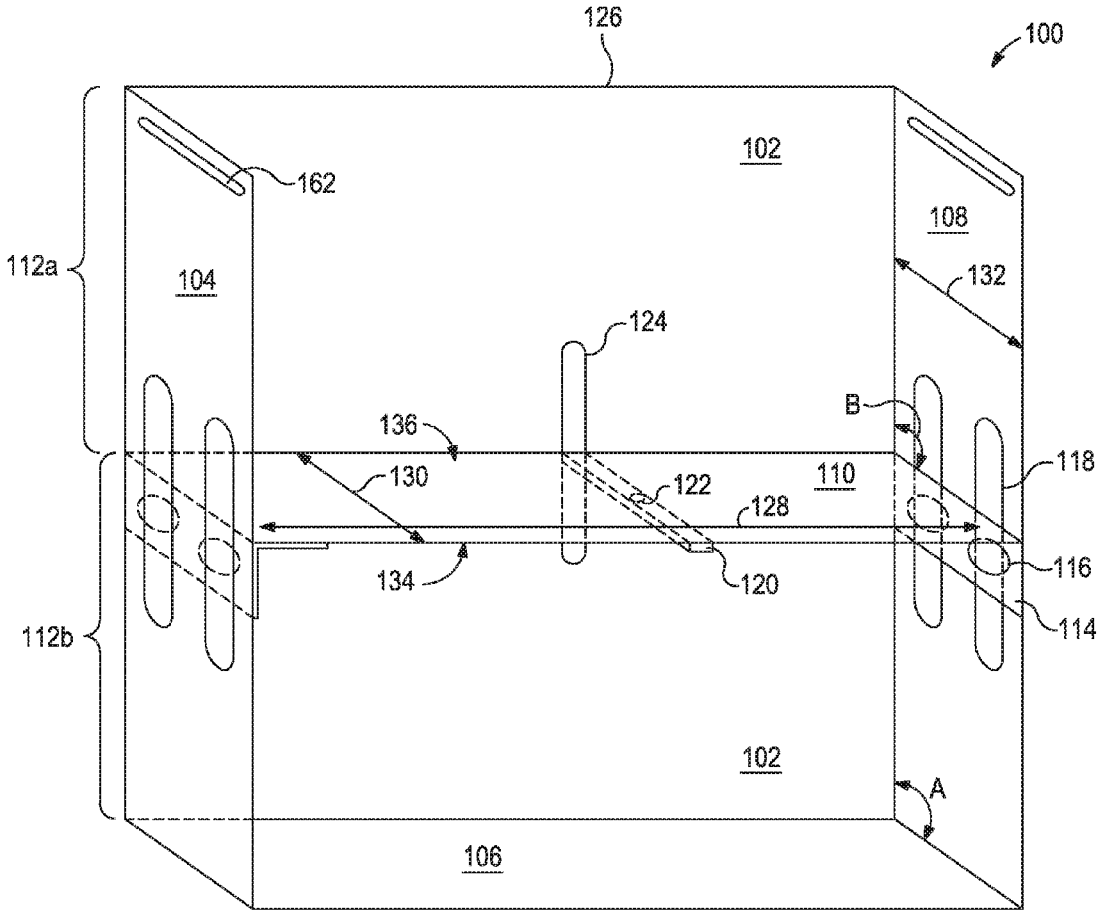
FIG. 1 provides an isometric top view illustration of a modified feeding tray suitable for use in conjunction with combining machines for containing and transporting porous masses.

Referring to FIG. 1, illustrated is an diagram of an exemplary modified feeding tray 100 suitable for use in conjunction with combining machines for containing and transporting porous masses, according to one or more embodiments. The modified feeding tray 100 may be defined by a bottom 102 that is generally rectangular and three sidewalls 104, 106, and 108. The sidewalls 104, 106, and 108 extend generally perpendicularly from the bottom 102 along three of the edges of the bottom 102. In some instances, the sidewall 106 may extend from the bottom 102 at an angle A of less than 90° (e.g., about 75° to about 90°). The sidewalls 104, 106, and 108 may be connected at two of the corners of bottom 102 and are arranged such that sidewalls 104 and 108 are parallel to each other and orthogonal to sidewall 106, where the sidewall 106 extends between the sidewalls 104, 108. The sidewalls 104 and 108 may include elongated holes 162 along their depth 132 proximal to the open edge 126 of the bottom 106. The elongated holes 162 may be configured to receive a removable gate therethrough (illustrated in FIG. 2).

The modified feeding tray 100 may further include a shelf 110 that extends between the opposing sidewalls 104 and 108 and is generally parallel to sidewall 106 where angle B may be less than 90° (e.g., about 75° to about 90°). The shelf 110 defines two compartments 112 within the modified feeding tray 100, shown as an open compartment 112*a* and a closed compartment 112*b*. The open compartment 112*a* may be defined by the opposing sidewalls 104 and 108, a first surface 136 of the shelf 110, and the bottom 102. The closed compartment 112*b* may be defined by the three sidewalls 104, 106, and 108, a second surface 134 of the shelf 110, and the bottom 102. The bottom 102 further defines an open edge 126. It should be noted that the use of "open" and "closed" are used for differentiating the two compartments (e.g., as having either three or four sidewalls, respectively) and should not be interpreted to be limiting as to the degree of access to the compartments. Further, it should be noted that the terms perpendicular (or orthogonal) and parallel as used herein encompass up to about 15° off perpendicular or parallel.

As illustrated, the shelf 110 may be a generally rectangular component exhibiting a length 128 sufficient to extend between the opposing sidewalls 104 and 108. The shelf 110 may further exhibit a depth 130 comparable to, and potentially equal to, the depth 132 of the opposing sidewalls 104 and 108. The shelf 110 may further define flanges 114 at opposing ends thereof. As illustrated, the flanges 114 may extend generally perpendicularly from the shelf 110 and otherwise parallel to the sidewalls 104 and 108. As a result, each flange 114 may be configured to abut the corresponding sidewalls 104 or 108.

Further, each flange 114 may be coupled or otherwise attached to the corresponding sidewalls 104 or 108. As illustrated in FIG. 1, each flange 114 may define one or more holes 116 (two shown on each flange 114) that spatially correspond to elongated slots 118 defined in the opposing sidewalls 104 and 108. The elongated slots 118 allow the shelf 110 to be laterally adjusted along the length of sidewalls 104 and 108. In order to couple the flanges 114 to the opposing sidewalls 104 and 108, one or more mechanical fasteners (not shown) may be used, such as nut and bolt assemblies (e.g., wingnuts) combined with one or more lock washers or spring-biased washers. The mechanical fasteners may be extended through the holes 116 and aligned slots 118 to secure the shelf 110 in the desired location along the length of opposing sidewalls 104 and 108.

In some embodiments, the modified feeding tray 100 may further include a support 120 operably connected to the bottom 102 so as to engage the shelf 110 at an intermediate point between the opposing sidewalls 104 and 108 and otherwise provide structural support to the shelf 110 when a load is applied thereto. As illustrated in FIG. 1, the support 120 extends from the bottom 102 along at least a portion of the depth 130 of the shelf 110 on the second surface 134. The support 120 may define a hole 122 therein that corresponds to an elongate slot 124 defined in the bottom 102. The shelf 110 may be movably coupled to the bottom 102 by using one or more mechanical fasteners (e.g., nut and bolt assemblies, lock washers, spring-biased washers, etc.) extended through the hole 122 and the aligned slot 124. By coupling the shelf 110 to the opposing sidewalls 104, 108 and the bottom 102, as generally described above, the overall size of the compartments 112*a* and 112*b* may be adjusted within the modified feeding tray 100.

One skilled in the art with the benefit of this disclosure will readily recognize various modifications that may be made to the modified feeding tray 100 to provide for comparable operation, without departing from the scope of the disclosure. For example, the holes 116 and elongated slots 118 may be replaced with a ratcheting mechanism, or an actuation device or the like that provides for movement and securing of the shelf 110 within the modified feeding tray 100. Further, flanges 114 may extend orthogonally from the shelf 110 away from the sidewall 106.

One skilled in the art with the benefit of this disclosure would recognize the various modifications to the modified feeding tray 100 and shelf 110 to allow for operable connection and similar performance. For example, the elongated slots 118 and holes 116 may be reversed such that the flanges 114 include the elongated slots and the sidewalls 104 and 108 include the holes. In another example, the number of holes and corresponding elongated slots in the various locations described may be varied. In yet another example, the shelf may have prongs rather than flanges 114 where the prongs extend from the shelf 110 along the length 128 of the shelf 110 so as to pass directly through the elongated slots 118 in the sidewalls 104 and 108 of the modified feeding tray 100. In some instances, these prongs may be threaded to allow for bolts or other mechanical fasteners to be used for securing the shelf in a desired position. In yet another example, the shelf 110 may be immovable either as part of a single molded modified feeding tray 100 or elongated holes 118 may be individual holes that correspond to a single position for the placement of the shelf 110.

Figure 2:
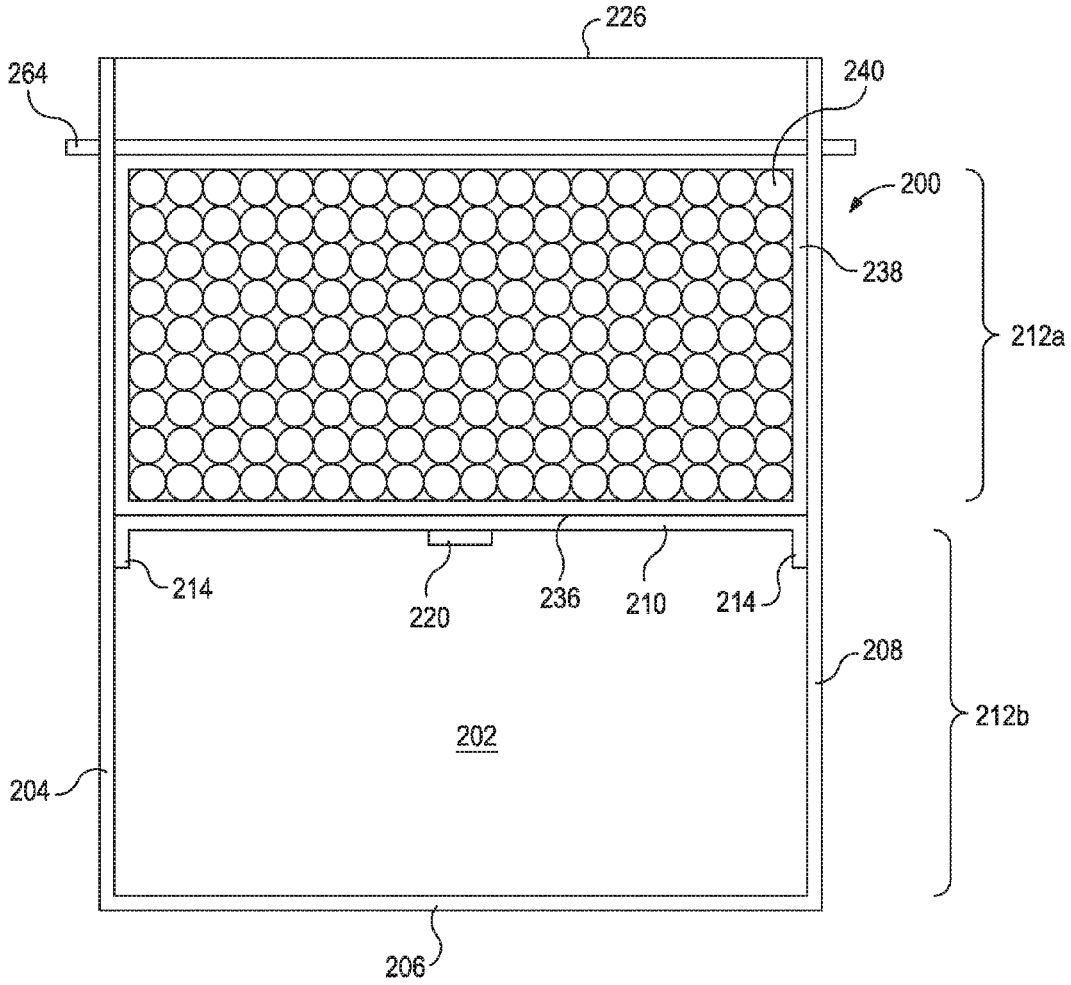
FIG. 2 provides a top view illustration of a modified feeding tray holding a container of porous masses.

Referring now to FIG. 2, illustrated is a diagram of a modified feeding tray 200 holding a container 238 of porous masses 240. The modified feeding tray 200 may be substantially similar to the modified feeding tray 100 of FIG. 1, and therefore may be best understood with reference thereto. The modified feeding tray 200 includes a bottom 202, three sidewalls 204, 206, and 208, an open edge 226, a shelf 210, and a support 220, where the shelf 210 defines the open compartment 212*a* and the closed compartment 212*b* in the modified feeding tray 200 in a similar fashion to that described in FIG. 1. The container 202 of porous masses 204 is disposed in the open compartment 212*a* and generally abuts the first surface 236 of the shelf 210. Generally, the container 238 is configured to fit within and substantially fill the open compartment 212*a* up to a first surface of removable gate 264 without extending beyond the depth of the sidewalls 204 and 208 (illustrated as 132 in FIG. 1). Advantageously, the ability resize the compartments 212*a* and 212*b* by moving the shelf 214 along the bottom 202 and the opposing sidewalls 204 and 208 makes the modified feeding tray 200 configurable to various sizes of containers 238.

Figure 3:
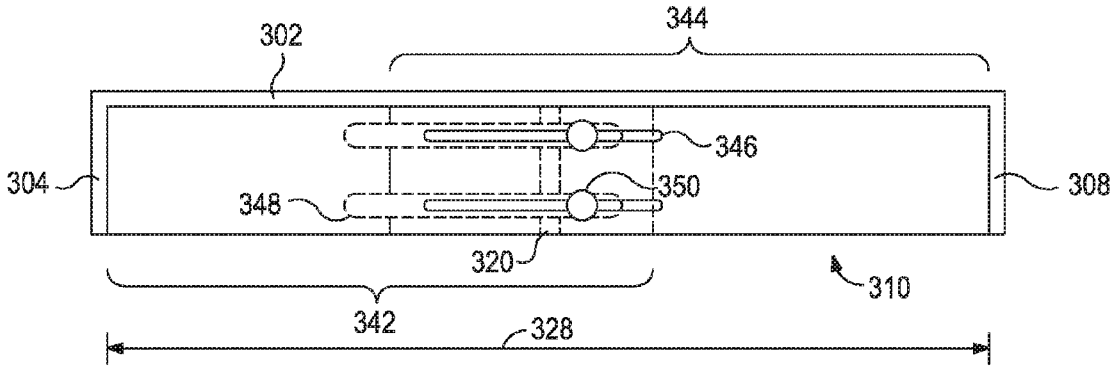
FIG. 3 provides a cross-sectional view illustration of a modified feeding tray at the shelf.

Referring now to FIG. 3, illustrated is a diagram of a modified feeding tray at the shelf 310 that has an adjustable length to accommodate feeding trays (e.g., feeding trays 100 or 200) of different sizes. The modified feeding tray may be substantially similar to the modified feeding trays 100 or 200 of FIGS. 1 and 2, respectively, and therefore may be best understood with reference thereto. For reference, the bottom 305, opposing sides 304 and 308, and the support 320 are illustrated. The shelf 310 includes two overlapping shelf pieces 342 and 344 slidably engaged with each other and operably connected such that they are able to move laterally with respect to each other in order to vary the overall length 328 of the shelf 310. As illustrated, the first shelf piece 344 includes one or more elongated slots 346 (two shown) that correspond to two or more elongated slots 348 (two shown) defined in the second shelf piece 342. One or more mechanical fasteners 350 (e.g., nut and bolt assemblies, lock washers, spring-biased washers, etc.) may be used in conjunction with the elongated slots 306, 308 to secure the length of the shelf 300 at a desired length. One of ordinary skill in the art with the benefit of this disclosure would recognize other configurations and operable connections to provide for the same functionality (e.g., ratcheting mechanism, sliding rails with clamps, and the like).

Generally, the container described herein for the porous masses should be sized to both be operable with a modified feeding tray described herein and provide for a total weight that is compatible with the mechanical arms of a combining machine used in producing segmented filters.

Figure 4:
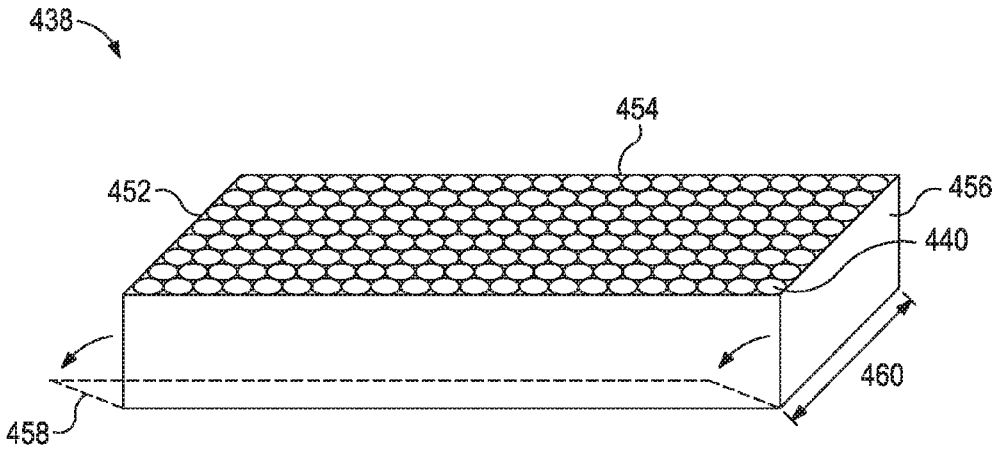
FIG. 4 provides an isometric view of an exemplary container with porous mass rods positioned upright therein.

FIG. 4 provides an isometric view of an exemplary container 438 with porous mass rods 440 positioned upright therein. As illustrated, the container 438 has four sidewalls 452, 454, 456, and 458 with one (at the forefront of FIG. 4) being a movable flap 458. The flap 458 may advantageously allow for loading the porous mass rods 440 into a combining machine (not shown). In exemplary operation, the flap 458 may be positioned within a modified feeding tray, such as the modified feeding tray 100 of FIG. 1, to correspond to the open edge 126 of the bottom 102.

In some instances, the sidewalls 452 and 456 of the container 438 may have a height 460 of about 6 in (15.2 cm) to about 20 in (50.8 cm), about 6 in (15.2 cm) to about 16 in (40.6 cm), or about 6 in (15.2 cm) to about 12 in (30.5 cm) including any subset therebetween.

The container 438 may be made of any material suitable for withstanding the weight of the porous masses without failing. Suitable materials may include, but are not limited to, cardboard (e.g., 3/16" or greater), plastic, plastic mesh, metal, wood, composite materials, any combination thereof, and the like, and. In some preferred embodiments, cardboard used to make the container 438 may be about 3/8 inch thick. In some embodiments, the cardboard may have a burst strength of about 200 pounds per square inch or greater. In some embodiments, the cardboard may be multi-ply.

In some instances, when filled with porous masses, the container 438 may have a total weight of at least about 4 kg to less than about 10 kg, less than about 8 kg, or less than about 6 kg.

Some embodiments described herein may include a system that comprises a combining machine and one or more modified feeding trays that are configured to (1) receive a container of porous masses as generally described herein and (2) operably connect to the combining machine so as to provide the porous masses from the container into the combining machine.

Unless indicated to the contrary, any numerical parameters set forth in the following specification and attached claims are approximations that may vary depending upon the desired properties sought to be obtained by the present invention. At the very least, and not as an attempt to limit the application of the doctrine of equivalents to the scope of the claim, each numerical parameter should at least be construed in light of the number of reported significant digits and by applying ordinary rounding techniques.

One or more illustrative embodiments incorporating the principles disclosed herein are presented below. Not all features of an actual implementation are described or shown in this application for the sake of clarity. It is understood that in the development of an actual embodiment incorporating the present invention, numerous implementation-specific decisions must be made to achieve the developer's goals, such as compliance with system-related, business-related, government-related and other constraints, which vary by implementation and from time to time. While a developer's efforts might be complex and time-consuming, such efforts would be, nevertheless, a routine undertaking for those of ordinary skill the art having benefit of this disclosure.

One embodiment disclosed herein (Embodiment A) includes a modified feeding tray that includes a rectangular bottom; opposing first and second sidewalls coupled to corresponding first and second edges of the rectangular bottom; a third sidewall coupled to a third edge of the rectangular bottom and extending between the first and second sidewalls; and a shelf extending between the first and second sidewalls at an intermediate location along a length of each of the first and second sidewalls and thereby defining an open compartment formed by the first and second sidewalls, the shelf, and the bottom, and a closed compartment defined by the first, second, and third sidewalls, the shelf, and the bottom.

Additional embodiments may include Embodiment A with one or more of the following additional elements in any combination: Element 1: the shelf being repositionable along the length of the first and second sidewalls, thereby varying a size of each of the open and closed compartments; Element 2: the shelf further comprising flanges defined at opposing ends of the shelf, the flanges extending perpendicularly from the shelf and parallel to the first and second sidewalls; Element 3: the shelf further comprising flanges defined at opposing ends of the shelf, the flanges extending perpendicularly from the shelf and parallel to the first and second sidewalls, and the first and second sidewalls being coupled to the flanges defined at the opposing ends of the shelf; Element 4: Element 3 wherein the first and second sidewalls are movably coupled to the flanges; Element 5: Element 4 wherein the first and second sidewalls define one or more elongated slots and the flanges define one or more holes corresponding to the one or more elongated slots, and wherein one or more mechanical fasteners are used to couple the first and second sidewalls to the flanges using the one or more elongated slots and the one or more holes; Element 6: the modified feeding tray further comprising a support operably connected to the bottom so as to engage the shelf at an intermediate point between the opposing sidewalls and provide structural support to the shelf when a load is applied thereto; and Element 7: the shelf being at an angle of about 75° to about 90° relative to the bottom.

By way of non-limiting example, exemplary combinations applicable Embodiment A include: Element 6 in combination with at least one of Elements 2-5; Element 1 in combination with at least one of elements 2-6; and Element 7 in combination with any of the foregoing.

Another embodiment disclosed herein (Embodiment B) includes a system that includes a combining machine and one or more modified feeding trays (according to Embodiment A optional in combination with at least one of Elements 1-7) that are configured to (1) receive a container of porous masses and (2) operably connect to the combining machine so as to provide the porous masses from the container into the combining machine.

Additional embodiments may include Embodiment A with one or more of the following additional elements: Element 8: the container of porous masses weighting from about 4 kg to about 10 kg; and Element 9: the container having sidewalls with a height of about 6 in (15.2 cm) to about 20 in (50.8 cm).

To facilitate a better understanding of the present invention, the following examples of preferred or representative embodiments are given. In no way should the following examples be read to limit, or to define, the scope of the invention.

EXAMPLES

A standard feeding tray (commercially-available from Hauni Maschinenbau AG) was modified to include slots in the two parallel and opposing sidewalls. A shelf was built with two shelf pieces each having flanges with elongated holes therein that correspond to the slots in the two parallel sidewalls. The shelf also included an adjustable length mechanism similar to that described in FIG. 3. Further, a support was included that is fastened to the bottom with a bracket. Because the bottom is a lattice structure, the support can be removed and refastening in a new position to allow for support of the shelf at varying positions along the two parallel sidewalls.

Figure 5:
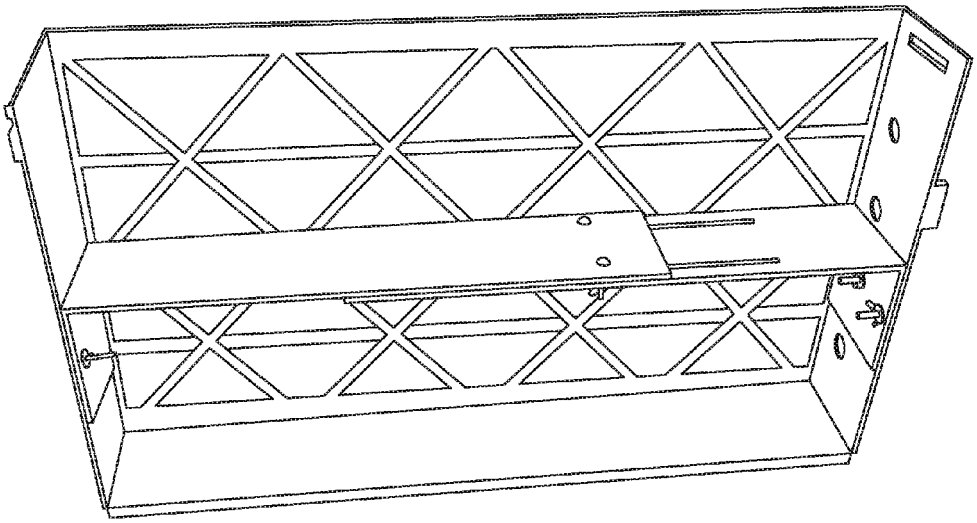
FIG. 5 provides a top view of an assembled modified feeding tray according to at least one embodiment described herein.
Figure 6:
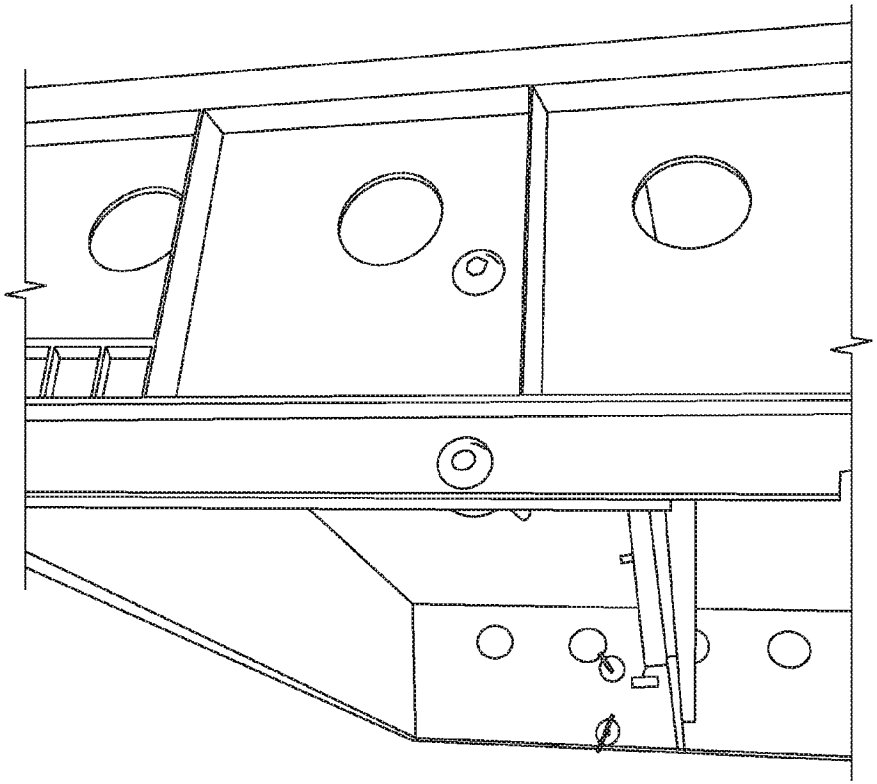
FIG. 6 provides an angled view of an assembled modified feeding tray according to at least one embodiment described herein.
Figure 7:
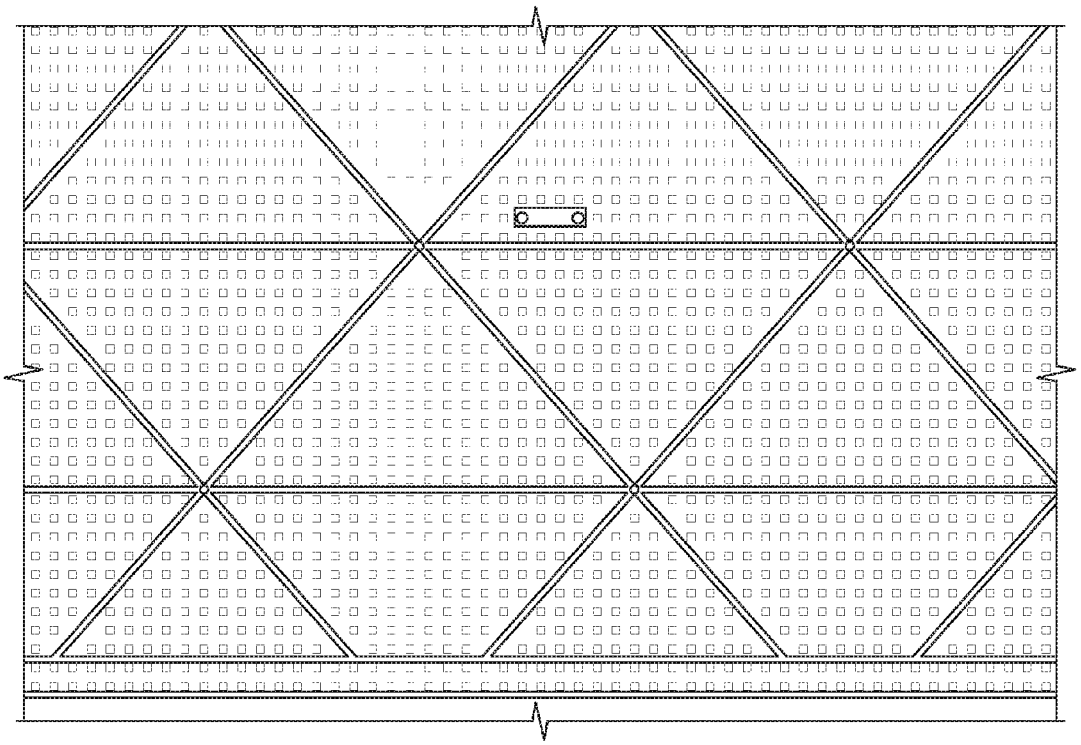
FIG. 7 provides a bottom view of an assembled modified feeding tray according to at least one embodiment described herein.
Figure 8:
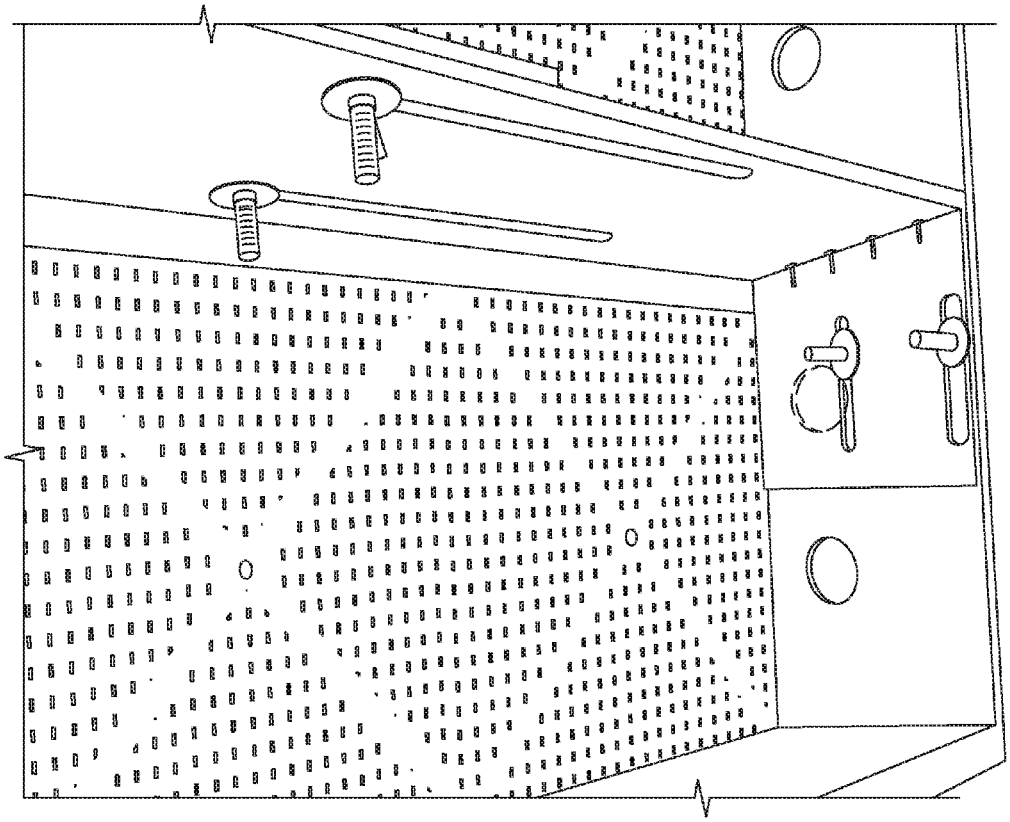
FIG. 8 provides a close up view of a shelf in an assembled modified feeding tray according to at least one embodiment described herein.
Figure 9:
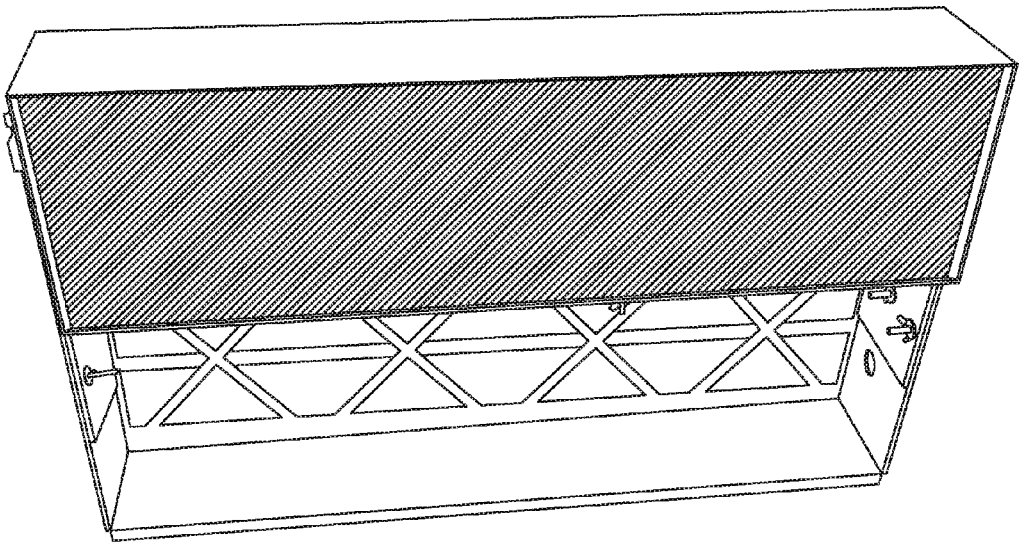
FIG. 9 provides an isometric view of a container of porous masses in an assembled modified feeding tray according to at least one embodiment described herein.

The assembled modified feeding tray is shown from a top view in FIG. 5, an angled side view in FIG. 6 showing the fastening of the shelf to the sidewall of the modified feeding tray, a bottom view in FIG. 7 showing the fastening mechanism for the support, and a close up view in FIG. 8 of the adjustable length mechanism of the shelf. Further, FIG. 9 provides a view of a container of porous masses within the modified feeding tray. In this example, the shelf is at about 9° to about 10° off-perpendicular from the bottom (i.e., angle B of FIG. 1 is about 80° to about 81°).

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A modified feeding tray comprising:

a rectangular bottom;

opposing first and second sidewalls coupled to corresponding first and second edges of the rectangular bottom;

a third sidewall coupled to a third edge of the rectangular bottom and extending between the first and second sidewalls;

a shelf extending from the first sidewall to the second sidewall at an intermediate location along a length of each of the first and second sidewalls and thereby defining an open compartment formed by the first and second sidewalls, the shelf, and the bottom, and a closed compartment defined by the first, second, and third sidewalls, the shelf, and the bottom;

a support within the closed compartment that operably connects to and extends from the bottom along at least a portion of a depth of the shelf; and an elongated slot in the bottom corresponding to the support such that the support is moveably coupled to the bottom along the elongated slot using one or more mechanical fasteners.

2. The modified feeding tray of claim 1, wherein an angle in the open compartment defined by the bottom and the shelf is less than 90° .

3. The modified feeding tray of claim 1, wherein the shelf is repositionable along the first and second sidewalls, thereby varying a size of each of the open and closed compartments.

4. The modified feeding tray of claim 1, wherein the shelf further comprises flanges defined at opposing ends of the shelf, the flanges extending perpendicularly from the shelf and parallel to the first and second sidewalls.

5. The modified feeding tray of claim 4, the flanges defined at the opposing ends of the shelf are moveably coupled to the first and second sidewalls.

6. The modified feeding tray of claim 1 further comprising:

a removable gate extending between and through the first and second sidewalls in the open compartment.

* * * * *